US006446323B1

(12) United States Patent
Metcalfe et al.

(10) Patent No.: US 6,446,323 B1
(45) **Date of Patent: *Sep. 10, 2002**

(54) PROFILE FORMATION

(75) Inventors: Paul David Metcalfe, Peterculter; Neil Andrew Abercrombie Simpson, Aberdeen, both of (GB)

(73) Assignee: Weatherford/Lamb, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,176

(22) Filed: Dec. 22, 1999

(30) Foreign Application Priority Data

| | | |
|---|---|---|
| Dec. 22, 1998 | (GB) | 9828234 |
| Jan. 15, 1999 | (GB) | 9900835 |
| Oct. 8, 1999 | (GB) | 9923783 |
| Oct. 13, 1999 | (GB) | 9924189 |

(51) Int. Cl.[7] ..... B21D 39/04; B21D 39/10
(52) U.S. Cl. ..... 29/523; 72/123
(58) Field of Search ..... 72/71, 123; 29/523; 166/55.8

(56) References Cited

U.S. PATENT DOCUMENTS

| | | | | |
|---|---|---|---|---|
| 761,518 A | * | 5/1904 | Lykken | 72/123 |
| 1,301,285 A | | 4/1919 | Leonard | |
| 1,324,303 A | * | 12/1919 | Carmichael | 166/55.8 |
| 1,545,039 A | | 7/1925 | Deavers | |
| 1,561,418 A | | 11/1925 | Duda | |
| 1,569,729 A | | 1/1926 | Duda | |
| 1,597,212 A | | 8/1926 | Spengler | |
| 1,880,218 A | | 10/1932 | Simmons | |
| 1,930,825 A | | 10/1933 | Raymond | |
| 1,981,525 A | | 11/1934 | Price | 166/4 |
| 2,017,451 A | | 10/1935 | Wickersham | 166/10 |
| 2,214,226 A | | 9/1940 | English | 166/1 |
| 2,383,214 A | | 8/1945 | Prout et al. | 153/82 |
| 2,424,878 A | | 7/1947 | Crook | 154/82 |
| 2,499,630 A | | 3/1950 | Clark | 153/81 |
| 2,519,116 A | | 8/1950 | Crake | 166/10 |
| 2,627,891 A | | 2/1953 | Clark | 153/82 |
| 2,633,374 A | | 3/1953 | Boice | 285/118 |
| 2,663,073 A | * | 12/1953 | Bieber et al. | 29/523 |
| 2,898,971 A | * | 8/1959 | Hempel | 29/523 |
| 3,028,915 A | | 4/1962 | Jennings | 166/16 |
| 3,039,530 A | | 6/1962 | Condra | 166/55 |
| 3,087,546 A | * | 4/1963 | Woolley | 166/55.8 |
| 3,167,122 A | | 1/1965 | Lang | 166/14 |
| 3,179,168 A | | 4/1965 | Vincent | 166/14 |
| 3,186,485 A | | 6/1965 | Owen | 166/63 |

(List continued on next page.)

FOREIGN PATENT DOCUMENTS

| | | | |
|---|---|---|---|
| DE | 3213464 A1 | 10/1983 | B23E/45/12 |
| DE | 4133802 C1 | 10/1992 | F16L/9/12 |
| EP | 0 952 305 A1 | 4/1998 | E21B/43/10 |

(List continued on next page.)

OTHER PUBLICATIONS

Metcalfe, P.—"Expandable Slotted Tubes Offer Well Design Benefits", *Petroleum Engineer International*, vol. 69, No. 10 (Oct. 1996), pp. 60–63—XP000684479.

(List continued on next page.)

*Primary Examiner*—Lowell A. Larson
(74) *Attorney, Agent, or Firm*—Moser, Patterson & Sheridan, L.L.P.

(57) ABSTRACT

A method of forming a profile (10) in a section of tubing (12) comprises: providing an expander device (14) having at least one radially extendable expander member (22); positioning the device (14) at a predetermined location in the tubing (12); and extending the member (22) to deform the tubing (12) to create a profile (10).

10 Claims, 3 Drawing Sheets

U.S. PATENT DOCUMENTS

| | | | | | |
|---|---|---|---|---|---|
| 3,191,677 | A | | 6/1965 | Kinley | 166/14 |
| 3,191,680 | A | | 6/1965 | Vincent | 166/46 |
| 3,195,646 | A | | 7/1965 | Brown | 166/208 |
| 3,203,451 | A | | 8/1965 | Vincent | 138/143 |
| 3,203,483 | A | | 8/1965 | Vincent | 166/207 |
| 3,245,471 | A | | 4/1966 | Howard | 166/46 |
| 3,297,092 | A | | 1/1967 | Jennings | 166/207 |
| 3,326,293 | A | | 6/1967 | Skipper | 166/150 |
| 3,353,599 | A | | 11/1967 | Swift | 166/15 |
| 3,354,955 | A | | 11/1967 | Berry | 166/14 |
| 3,467,180 | A | * | 9/1969 | Pensotti | 29/523 |
| 3,477,506 | A | | 11/1969 | Malone | 166/207 |
| 3,489,220 | A | | 1/1970 | Kinley | 166/277 |
| 3,583,200 | A | | 6/1971 | Cvijanovic et al. | 72/393 |
| 3,669,190 | A | | 6/1972 | Sizer et al. | 166/315 |
| 3,689,113 | A | | 9/1972 | Blaschke | 285/90 |
| 3,691,624 | A | | 9/1972 | Kinley | 29/523 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,785,193 | A | | 1/1974 | Kinley et al. | 72/393 |
| 3,818,734 | A | | 6/1974 | Bateman | 72/75 |
| 3,820,370 | A | | 6/1974 | Duffy | 72/75 |
| 3,911,707 | A | | 10/1975 | Minakov et al. | 72/76 |
| 3,948,321 | A | | 4/1976 | Owen et al. | 166/277 |
| 3,977,076 | A | | 8/1976 | Vieira et al. | 30/103 |
| 4,069,573 | A | * | 1/1978 | Rogers, Jr. et al. | 29/523 |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,319,393 | A | | 3/1982 | Pogonowski | 29/434 |
| 4,324,407 | A | | 4/1982 | Upham et al. | 277/27 |
| 4,349,050 | A | | 9/1982 | Bergstrom et al. | 138/147 |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,429,620 | A | | 2/1984 | Burkhardt et al. | 91/395 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 B |
| 4,502,308 | A | | 3/1985 | Kelly | 72/58 |
| 4,505,142 | A | | 3/1985 | Kelly | 72/54 |
| 4,505,612 | A | | 3/1985 | Shelley, Jr. | 405/101 |
| 4,531,581 | A | | 7/1985 | Pringle et al. | 166/120 |
| 4,567,631 | A | | 2/1986 | Kelly | 29/157.3 |
| 4,581,617 | A | | 4/1986 | Yoshimoto et al. | 346/108 |
| 4,588,030 | A | | 5/1986 | Blizzard | 166/120 |
| 4,626,129 | A | | 12/1986 | Kothmann et al. | 405/43 |
| 4,697,640 | A | | 10/1987 | Szarka | 166/120 |
| 4,807,704 | A | | 2/1989 | Hsu et al. | 166/313 |
| 4,848,469 | A | | 7/1989 | Baugh et al. | 166/382 |
| 4,866,966 | A | | 9/1989 | Hagan | 72/75 |
| 4,883,121 | A | | 11/1989 | Zwart | 166/217 |
| 4,976,322 | A | | 12/1990 | Abdrakhmanov et al. | 175/57 |
| 4,997,320 | A | | 3/1991 | Hwang | 408/22 |
| 5,014,779 | A | | 5/1991 | Meling et al. | 166/55.7 |
| 5,052,483 | A | | 10/1991 | Hudson | 166/55 |
| 5,052,849 | A | | 10/1991 | Zwart | 403/300 |
| 5,156,209 | A | | 10/1992 | McHardy | 166/324 |
| 5,267,613 | A | | 12/1993 | Zwart et al. | 166/178 |
| 5,271,472 | A | | 12/1993 | Leturno | 175/107 |
| 5,301,760 | A | | 4/1994 | Graham | 175/61 |
| 5,307,879 | A | | 5/1994 | Kent | 166/382 |
| 5,322,127 | A | | 6/1994 | McNair et al. | 166/313 |
| 5,348,095 | A | | 9/1994 | Worrall et al. | 166/380 |
| 5,366,013 | A | | 11/1994 | Lohbeck | 166/277 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,520,255 | A | | 5/1996 | Barr et al. | 175/24 |
| 5,553,679 | A | | 9/1996 | Thorp | 175/73 |
| 5,560,426 | A | | 10/1996 | Trahan et al. | 166/120 |
| 5,636,661 | A | | 6/1997 | Moyes | 137/614.2 |
| 5,667,011 | A | | 9/1997 | Gill et al. | 166/295 |
| 5,685,369 | A | | 11/1997 | Ellis et al. | 166/195 |
| 5,706,905 | A | | 1/1998 | Barr | 175/61 |
| 5,785,120 | A | | 7/1998 | Smalley et al. | 166/55 |
| 5,887,668 | A | | 3/1999 | Haugen et al. | 175/79 |
| 5,901,787 | A | | 5/1999 | Boyle | 166/135 |
| 5,901,789 | A | | 5/1999 | Donnelly et al. | 166/381 |
| 5,924,745 | A | | 7/1999 | Campbell | 285/90 |
| 5,960,895 | A | | 10/1999 | Chevallier et al. | 175/27 |
| 5,979,571 | A | | 11/1999 | Scott et al. | 175/61 |
| 6,021,850 | A | | 2/2000 | Wood et al. | 166/380 |
| 6,029,748 | A | | 2/2000 | Forsyth et al. | 166/380 |
| 6,070,671 | A | | 6/2000 | Cumming et al. | 166/381 |
| 6,098,717 | A | | 8/2000 | Bailey et al. | 166/382 |

FOREIGN PATENT DOCUMENTS

| | | | | |
|---|---|---|---|---|
| EP | 0 961 007 | A2 | 12/1999 | E21B/33/10 |
| GB | 730338 | | 3/1954 | 84/4 |
| GB | 792886 | | 4/1956 | |
| GB | 997721 | | 7/1965 | |
| GB | 1277461 | | 6/1972 | B21D/39/04 |
| GB | 1448304 | | 9/1976 | E21B/33/13 |
| GB | 1457843 | | 12/1976 | B21D/39/10 |
| GB | 1582392 | | 1/1981 | B21D/39/10 |
| GB | 2216926 | A | 10/1989 | E21B/7/20 |
| GB | 2 313 860 | B | 6/1996 | E21B/10/34 |
| GB | 2 320 734 | A | 7/1998 | E21B/33/127 |
| GB | 2329918 | A | 4/1999 | E21B/43/10 |
| WO | WO 92/01139 | | 1/1992 | E21B/17/08 |
| WO | WO 93/24728 | | 12/1993 | E21B/17/10 |
| WO | WO 93/25800 | | 12/1993 | E21B/43/10 |
| WO | WO 9425655 | | 11/1994 | D04C/1/06 |
| WO | WO 97/21901 | | 6/1997 | E21B/17/08 |
| WO | WO 98/00626 | | 1/1998 | E21B/43/10 |
| WO | WO 99/02818 | | 1/1999 | E21B/43/10 |
| WO | WO 99/18328 | | 4/1999 | E21B/23/01 |
| WO | WO 99/23354 | | 5/1999 | E21B/43/10 |

OTHER PUBLICATIONS

U.S. patent application Ser. No. 09/554,677, Wayne Rudd, filed May 17, 2000.

U.S. patent application Ser. No. 09/530,301, Metcalfe, filed Jun. 8, 2000.

U.S. patent application Ser. No. 09/470,154, Metcalfe et al., filed Dec. 22, 1999.

U.S. patent application Ser. No. 09/469,692, Trahan, filed Dec. 22, 1999.

U.S. patent application Ser. No. 09/469,690, Abercrombie, filed Dec. 22, 1999.

U.S. patent application Ser. No. 09/469,681, Metcalfe et al., filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/462,654, Metcalfe, filed Dec. 19, 2000.

PCT International Search Report from PCT/GB99/04248, Dated Jun. 16, 2000.

UK Search Report from GB 9930397.6 Dated Jun. 6, 2000.

* cited by examiner

RUNNING IN

SETTING

PULLING OUT

PROFILE FORMATION

This invention relates to a downhole profile formation, and in particular the formation or provision of profiles in cased boreholes. The invention also relates to cutting or otherwise forming casing.

In the oil and gas exploration and production industries, subsurface hydrocarbon-bearing formations are accessed via drilled boreholes lined with steel tubing, known as casing. The casing will often define profiles, typically annular recesses or annular restrictions, to facilitate the location and mounting of tools and devices in the borehole. The profiles are formed in the casing before it is run into the borehole, and are positioned in the string of casing at predetermined locations. This places restrictions on the subsequent placement of tools and devices in the bore, and the original profile locations may prove not to be appropriate as the well is developed. Further, different tool manufacturers utilise different profiles, and once the casing is in place an operator may be committed to obtaining tools from a single source throughout the life of the well.

It is among the objectives of embodiments of the invention to obviate and mitigate these difficulties.

According to a first aspect of the present invention there is provided a method of forming a profile in a section of tubing, the method comprising:

providing an expander device having at least one radially extendable expander member;

positioning the device at a predetermined location in a section of tubing;

extending the member to deform the tubing at said location to create a profile therein.

The invention facilitates the formation of a profile at a desired location in a section of tubing, such that, for example, an operator is not constrained to utilising preformed profiles of particular configuration at fixed locations in the tubing.

The profile may take any appropriate form, including one or more annular recesses, one or more circumferentially spaced recesses, and a female thread. As such, the profile may permit or facilitate the location of tools or devices in the tubing at the profile location. Alternatively, the profile may serve as a reference point.

Preferably, the tubing is deformed by rolling expansion, that is an expander member is rotated within the tubing with a face in rolling contact with an internal face of the tubing. Such rolling expansion may cause compressive plastic deformation of the tubing and a localised reduction in wall thickness resulting in a subsequent increase in tubing diameter. Alternatively, where the tubing is constrained, for example by outer tubing or surrounding rock or cement, the tubing material may flow by virtue of the compressive plastic deformation to create a groove or raised profile. The tubing expander may take any appropriate form, and the expander member may be mechanically or fluid pressure activated. Conveniently, the expander member is in the form of a roller, and may define a raised circumferential rib or other profile to provide a high pressure contact area and to create a profile in the tubing of a predetermined form. Preferably, the expander member is extended by application of fluid pressure. In the preferred form, the expander member is in the form of a roller having a tapered end and is operatively associated with an axially movable piston and cam or wedge, although in other embodiments the member may itself define a piston which is radially movable in response to internal expander tool pressure. Preferably, a plurality of expander members are provided, and most preferably a plurality of the expander members are radially extendable.

Preferably, the member is run into the tubing on a running string, which may be reelable, such as coil tubing. The running string may be rotated to create the profile, or a motor may be mounted in the running string to rotate the expander.

The tubing may be in the form of a riser tube, as used to connect an offshore platform, rig or ship to a subsea wellhead assembly. Alternatively, the tubing may be in the form of bore-lining tubing, such as casing or liner, or may be production tubing.

According to a second aspect of the present invention there is provided a method of forming a profile in a section of tubing, the method comprising deforming a section of tubing by rolling expansion to create a profile therein.

According to another aspect of the present invention there is provided a method of providing a profile in a section of tubing, the method comprising:

providing a ring of deformable material;

providing an expander device having at least one radially extendable member;

positioning the ring and the device at a predetermined location in a section of tubing;

extending the member to deform the ring such that the ring engages the tubing at said location to create a profile therein.

According to a further aspect of the present invention there is provided apparatus for providing a profile in a section of tubing, the apparatus comprising: a ring of deformable material; and an expander device having at least one radially extendable member, the device being locatable within the ring and the member being extendable to deform the ring into engagement with surrounding tubing to create a profile therein.

These aspects of the invention offers additional advantages to the aspects of the invention described above. In certain applications it may be difficult to deform existing tubing, which would be the case with, for example, heavy gauge cemented casing or hardened tubing, and these aspects of the invention obviate these difficulties by locating a ring in the casing. Further, the ring may provide a restriction in the tubing, which may be utilised as a "no-go" to locate tools and other devices in the tubing. The ring may be preformed to define any predetermined profile, for example a thread, lip, recess or wedge.

Preferably, the ring and the expander device are run into the tubing together. Most preferably, the expander member is profiled to provide a mounting for the ring.

Preferably, the ring is deformed to form an interference fit with the tubing, most preferably by increasing the diameter of a section of the ring. Most preferably, the ring is deformed by rolling expansion, that is an expander member is rotated within the ring with a face in rolling contact with an internal face of the ring. Such rolling expansion causes compressive plastic deformation or yield of the ring and a localised reduction in wall thickness resulting in a subsequent increase in ring diameter.

The ring may comprise a relatively ductile portion welded or otherwise connected to a relatively inflexible portion, the deformation of the ring being restricted to the relatively ductile portion.

The ring may carry grip banding or the like on an outer surface to facilitate secure location relative to the tubing. The grip banding may comprise relatively hard elements such as grit or balls formed of hard material such as tungsten carbide.

According to yet another aspect of the present invention there is provided a method of providing a profile in a section of tubing, the method comprising deforming a ring of material by rolling expansion within a section of tubing such that the ring engages the tubing at said location to create a profile therein.

According to a still further aspect of the present invention there is provided a method of cutting a section of tubing, the method comprising:

providing a cutting device having at least one radially extendable rolling member defining a raised circumferential portion;

positioning the device at a predetermined location in a section of tubing;

extending the member to contact the tubing at said location and rotating the device to deform the tubing, the degree of deformation being such that the tubing is cut at said location.

This aspect of the invention may be used in many different applications, for example severing a riser which cannot be released from a wellhead assembly, or cutting a section of casing or liner.

Preferably, the cutting device is provided with a plurality of rolling members, which progressively compress the tubing wall and reduce the wall thickness thereof.

These and other aspects of the present invention will now be described, by way of example, with reference to the accompanying drawings, in which.

Figure 1:
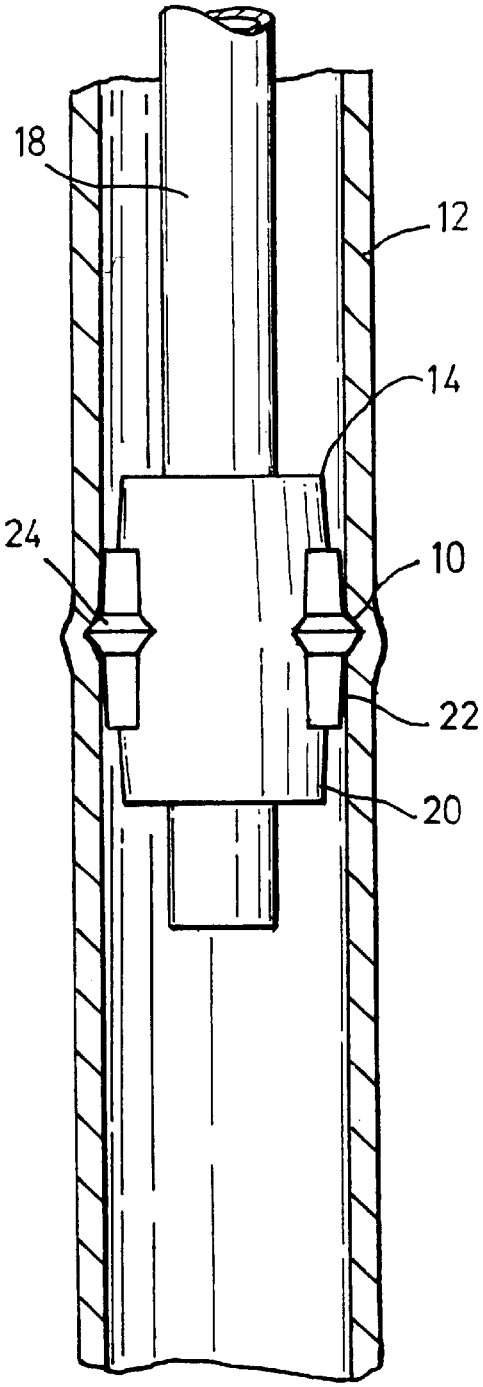
FIG. 1 is a schematic sectional view of a stage in a method of forming a profile in a section of tubing in accordance with an embodiment of an aspect of the present invention.

Reference is first made to FIG. 1 of the drawings, which is a schematic sectional view of a stage in a method of forming a profile 10 a section of downhole tubing 12 in accordance with an embodiment of an aspect of the present invention. In this example the tubing 12 is in the form of bore-lining casing. The profile 10 is useful for locating tools and devices in the tubing 12 and is formed using an expander device 14 as will be described.

The expander device 14 in run into the tubing 12 on a tool string 18 and comprises a body 20 carrying three radially extendable rollers 22, each defining a raised central rib 24. The rollers 22 have tapered ends and are mounted on cones coupled to a piston which is axially movable in response to pressure applied to the interior of the expander body 20 via the tool string 18.

In use, the device 14 is run into the tubing 12 with the rollers 22 in the retracted configuration. Once at a desired location in the tubing 12 the device 14 is activated by applying pressure through the string 18, to urge the rollers 22 radially outwardly. At the same time, the string is rotated from surface, or from an appropriate downhole motor, such that the rollers 22 are in rolling contact with the inner wall of the tubing 12 and subject the tubing wall to pressure sufficient to induce compressive yield and a localised reduction in wall thickness. This in turn causes the diameter of the tubing to increase, and creates the profile 10.

Profiles may be provided at any location in the tubing 12 which may accommodate the necessary deformation. However, in some situations, it may be difficult to create the necessary deformation; cemented heavy gauge casing may be difficult to deform to any significant extent. In this case, a profile may be provided in the tubing, as will now be described with reference to FIGS. 2 and 3 of the drawings.

In other embodiments of this aspect of the invention, particularly when the tubing 12 is constrained within a bore or other tubing or by surrounding rock or cement, where it not possible for the tubing diameter to expand, the deformation mechanism is somewhat different in that the material of the tubing subject to compressive plastic deformation or yield will tend to flow to create the profile, without the creation of a corresponding "bulge" in the outer wall of the tubing.

Figure 2:
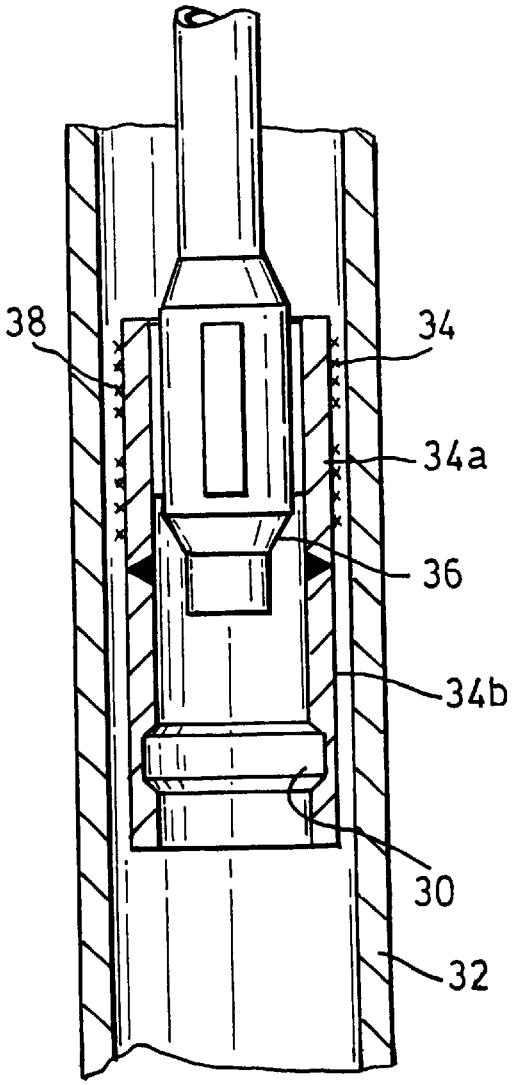
FIGS. 2 and 3 are schematic sectional views of stages in a method of providing a profile in a section of tubing in accordance with an embodiment of another aspect of the present invention.

FIG. 2 is a schematic sectional view of a stage in a method of providing a profile 30 in a section of tubing 32 in accordance with an embodiment of another aspect of the present invention. The profile 30 is formed in a ring 34 which is located in the tubing 32, as described below, utilising an expander device 36 generally similar to the device 14 described above.

The ring 34 is initially generally cylindrical and comprises an relatively ductile anchoring portion 34*a* which carries grip bands of tungsten carbide chips 38 on its outer face. The anchoring portion 34*a* is welded to a portion 34*b* or harder material which defines the profile 30.

Figure 3:
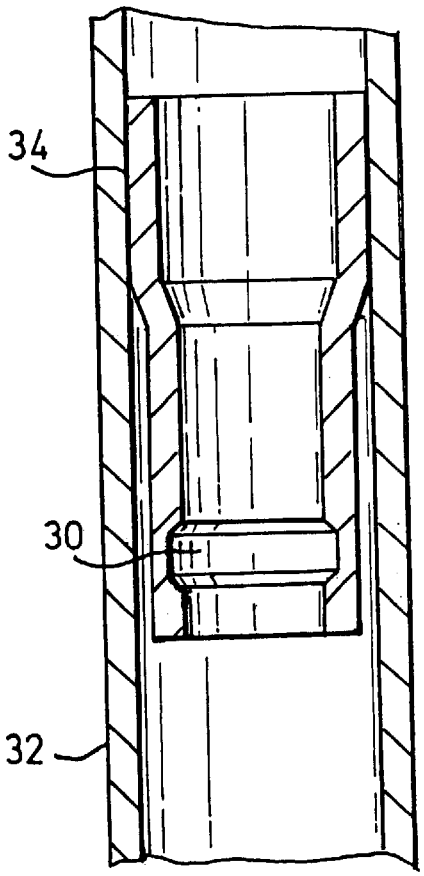

In use, the ring 34 is run into the tubing 32 with the expander device 36 located in the anchoring portion 34*a*. On reaching the desired location, the expander device rollers 40 are first extended to deform the anchoring portion 34*a* to a generally triangular form, such that areas of the portion 34*a* corresponding to the roller locations are pushed into contact with the tubing wall. Such contact prevents relative rotation of the ring 34 relative to the tubing 32. The device 40 is then rotated relative to the ring 34 and tubing 32. In a somewhat similar manner to the tubing 12 of the first described embodiment, the anchoring portion 34*a* is then deformed by compressive yield and thus circumferentially extended to create an annular area of interference fit with the tubing 32. The expander device 36 is then retracted, leaving the ring 34 locked in the tubing 32, as illustrated in FIG. 3, and the profile 30 ready to, for example, locate and provide mounting for a valve or the like.

Figure 4:
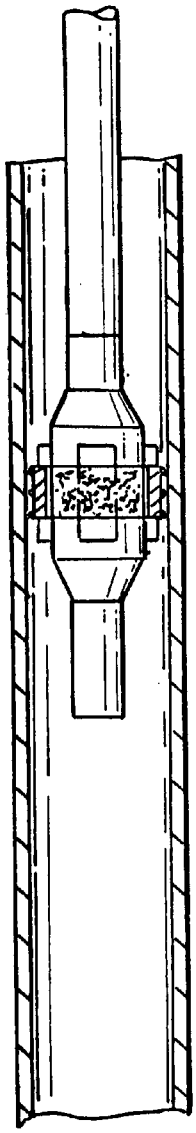
FIGS. 4, 5 and 6 are schematic sectional views of stages in a method of providing a profile in a section of tubing in accordance with a second embodiment of said another aspect of the present invention.
Figure 5:
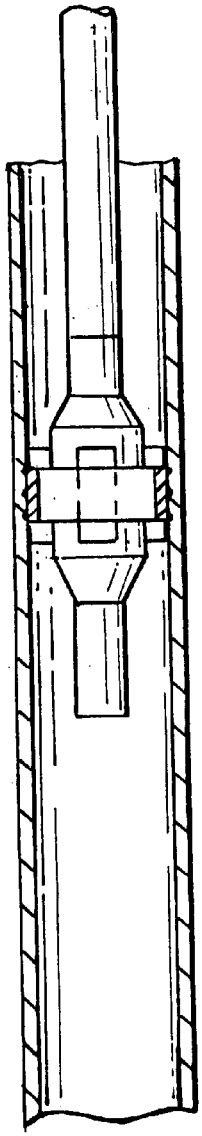
Figure 6:
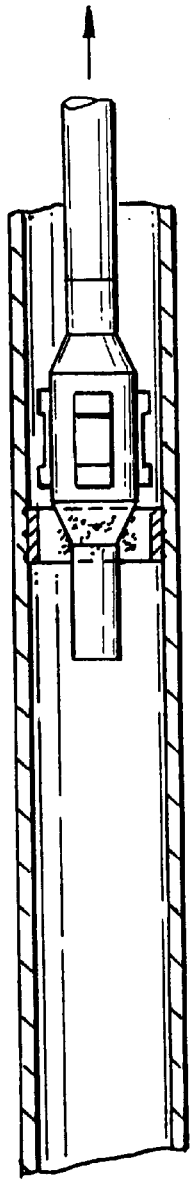

Reference is now made to FIGS. 4, 5 and 6 of the drawings, which illustrate stages in a method of providing a profile 60 in a section of tubing 62 in accordance with a second embodiment of said another aspect of the present invention. The profile 60, in the form of a bore restriction or reference point, is provided by a ring 64 of expandable metal. The ring 64 is set using an expander 66 similar to that described with reference to FIG. 2 and, in the interest of brevity, the setting operation will not be described in detail. However, the ring 64 is relatively short, and indeed is shorter in length than the expander rollers 68. This allows provision of a simplified ring-mounting arrangement. In particular, the rollers 68 are profiled, each defining a central recess 70 to receive the undeformed ring 64. On reaching the desired ring location, the rollers 68 are actuated and deform the ring 64 to engage the tubing 62, and the expander 66 is then rotated relative to the ring 64 and the tubing 62 to progressively deform the ring 64 to create the desired interference fit with the tubing 62. The rollers 68 are then retracted, and the expander 66 retrieved from the tubing 62.

Figure 7:
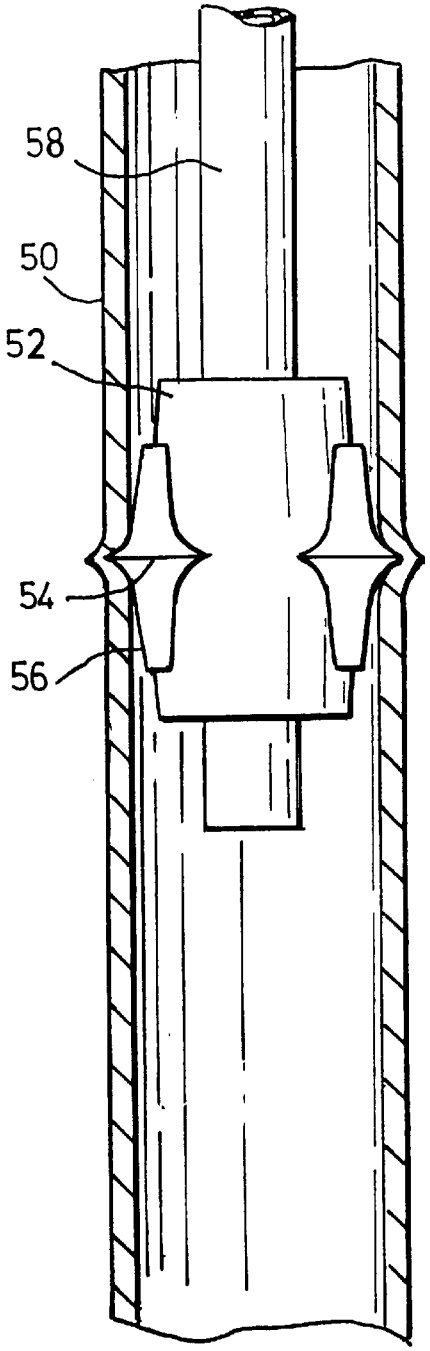
FIG. 7 is a schematic sectional view of a stage in a method of cutting tubing in accordance with an embodiment of a further aspect of the present invention (on same sheet as FIG. 1).

Reference is now made to FIG. 7 of the drawings, which is a schematic sectional view of a stage in a method of cutting tubing 50 in accordance with an embodiment of a further aspect of the present invention. The method utilises a cutter 52 of similar form to the expanders 14, 36 described above, other than the provision of a more pronounced and hardened rib 54 on each roller 56.

In use, the cutter 52 is run into the tubing to the desired location and energised, by application of fluid pressure via the supporting tool string 58, and simultaneously rotated. This extends the rollers 56 and urges the ribs 54 into rolling contact with the tubing 50. The high pressure forces created at the small area contact between the ribs 54 and the tubing 50 result in compressive yield of the tubing 50 and a localised reduction in tubing wall thickness. The progressive reduction in the wall thickness eventually results in the tubing being severed.

The behaviour of the material of the tubing 50 subject to compressive plastic deformation may vary depending on the tubing location. Where the tubing 50 is constrained, for example within an outer tubing, and the tubing diameter is not free to increase, the material of the tubing, typically steel, will flow away from the area subject to highest pressure. With appropriate roller configuration, it is therefore possible to cut inner tubing located within a larger diameter outer tubing, or tubing located within a device or tool.

As will be apparent to those of skill in the art, this ability to cut tubing downhole has many applications.

It will further be apparent to those of skill in the art that the above described embodiments are merely exemplary of the various aspects of the present invention and that various modifications and improvements may be made thereto without departing from the scope of the invention.

What is claimed is:

1. An apparatus for providing a profile in a section of tubing, the apparatus comprising:

a ring of deformable material; and an expander device having at least one radially extendable member, the device being locatable within the ring and the member being extendable to deform the ring and the member being extendable to deform the ring into engagement with surrounding tubing to create a profile having at least one annular recess.

2. The apparatus of claim 1, wherein the ring is preformed to define a predetermined profile.

3. The apparatus of claim 1, wherein the ring comprises a relatively ductile portion coupled to a relatively inflexible portion.

4. The apparatus of claim 1, wherein the ring comprises grip banding on an outer surface thereof to secure its location relative to the tubing.

5. The apparatus of claim 4, wherein the group banding comprises relatively hard elements.

6. The apparatus of claim 1, wherein the expander member is in the form or a roller.

7. The apparatus of claim 1, wherein the expander member is extendable by application of fluid pressure.

8. The apparatus of claim 1, wherein the expander device comprises a plurality of radially extendable expander members.

9. The apparatus of claim 1, wherein the expander device is adapted to be selectively rotatable relative to the ring.

10. The apparatus of claim 1, wherein the expander member is profiled to engage the ring and permit the ring to be run into the tubing on the expander.

* * * * *

UNITED STATES PATENT AND TRADEMARK OFFICE

CERTIFICATE OF CORRECTION

PATENT NO. : 6,446,323 B1 
DATED : September 10, 2002
INVENTOR(S) : Paul David Metcalfe et al.

It is certified that error appears in the above-identified patent and that said Letters Patent is hereby corrected as shown below:

Column 6,
Line 5, please delete the entire line "the member being extendable to deform the ring and".
Line 17, please change "group" to -- grip --.
Line 20, please change "or a roller." to -- of a roller. --.

Signed and Sealed this

Fourteenth Day of January, 2003

JAMES E. ROGAN
*Director of the United States Patent and Trademark Office*